US006830111B2

(12) United States Patent
Page

(10) Patent No.: US 6,830,111 B2
(45) Date of Patent: Dec. 14, 2004

(54) WALK BEHIND APPARATUS FOR OPERATING WORKING ATTACHMENTS

(75) Inventor: James H. Page, Bottineau, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 355 days.

(21) Appl. No.: 10/044,780

(22) Filed: Jan. 10, 2002

(65) Prior Publication Data

US 2002/0094263 A1 Jul. 18, 2002

Related U.S. Application Data

(60) Provisional application No. 60/261,296, filed on Jan. 12, 2001.

(51) Int. Cl.[7] ..... A01B 33/00; E02F 3/38

(52) U.S. Cl. ..... 172/42; 414/686

(58) Field of Search ..... 172/42–48, 107, 172/114, 118, 125, 351; 414/487, 685–688, 699, 700, 549–555, 565; 180/89.12; 280/760–769

(56) References Cited

U.S. PATENT DOCUMENTS

| | | | | |
|---|---|---|---|---|
| 1,371,344 A | | 3/1921 | Brackett | |
| D195,254 S | | 5/1963 | Keller et al. | D14/3 |
| D205,485 S | | 8/1966 | Juhl et al. | D14/3 |
| 3,411,647 A | | 11/1968 | Zimmerman | 214/770 |
| D294,032 S | | 2/1988 | Whiffin | D15/25 |
| D317,926 S | | 7/1991 | Lynnes et al. | D15/25 |
| 5,064,011 A | | 11/1991 | Ogano et al. | 180/9.22 |
| 5,212,896 A | | 5/1993 | Hillard et al. | 37/86 |
| 5,307,880 A | | 5/1994 | Woerner | 172/19 |
| D359,497 S | | 6/1995 | Rayner | D15/25 |
| 5,470,190 A | | 11/1995 | Bamford et al. | 414/686 |
| 5,542,814 A | | 8/1996 | Ashcroft et al. | 414/786 |
| 5,609,464 A | | 3/1997 | Moffitt et al. | 414/685 |
| 5,647,721 A | | 7/1997 | Rohrbaugh | 414/686 |
| 5,954,270 A | * | 9/1999 | Rosset | 239/159 |
| D431,574 S | | 10/2000 | Porter | D15/25 |
| D438,218 S | | 2/2001 | McIlwraith | D15/25 |
| 6,341,665 B1 | * | 1/2002 | Zhou et al. | 182/2.8 |
| 6,397,967 B1 | | 6/2002 | McIlwraith | 180/308 |
| D463,454 S | | 9/2002 | Miller et al. | D15/22 |
| 6,450,706 B1 | * | 9/2002 | Chapman | 396/428 |
| 6,568,547 B1 | * | 5/2003 | Kretschmer et al. | 212/196 |
| 6,588,792 B1 | * | 7/2003 | Koerlin et al. | 280/650 |

OTHER PUBLICATIONS

Brochure on Toro Dingo "So What's on This Weekend's Agenda?" published prior to Nov. 1, 2000 (admitted prior art).

Maximan Brochure (5 pages), Published before Nov. 1, 2000.

Maximan Web Pages (2 pages), Admitted prior art, published before Nov. 1, 2000.

Attachments for Loader (Bobcat), Published 1996.

Mertz, Inc. Boxer Advertisement, published at least as early as Nov. 1, 2000, 3 pages. (Admitted prior art).

Toro Dingo Tract Utility Loaders, TX400 Series Advertisement, published at least as early as Nov. 1, 2000, 3 pages. (Admitted prior art).

(List continued on next page.)

*Primary Examiner*—Robert E Pezzuto
(74) *Attorney, Agent, or Firm*—Westman, Champlin & Kelly, P.A.

(57) ABSTRACT

A walk behind powered apparatus for operating working attachments includes a ground engaging carriage with two endless tracks on opposite sides of the frame. A support frame attached to the carriage includes a pair of rearwardly and upwardly extending side plate members with upper end portions that pivotably support a boom and a controller. The boom is arcuately-shaped and has a working attachment at a forward end. The controller includes linkages which are connected to two drive units which enable independent operation of each endless track. The apparatus also includes at least one selectively positionable counterweight that may be moved relative to the vertical traverse plane passing through the center of gravity of the apparatus to increase the operational parameters of the apparatus.

15 Claims, 9 Drawing Sheets

OTHER PUBLICATIONS

Finn Skid Steer 250, Finn Corporation, published at least as early as Nov. 1, 2000, 5 pages.
Publications by Ramrod Equipment, Taskmaster Loaders, showing models 550, 750, 900, 910 and 944 with attachment pages, a total of 11 pages. Published at least as early as Nov. 1, 2000.
Gravely Skid Steer Loader information, published at least as early as Nov. 1, 2000, 7 pages.
Dexhoff Equipment Brochure, "entitled the new TIPSKIP 650", (2 pages), Published before Nov. 1, 2000.
Mertz, Inc. Brochure, entitled "TrackMaster HP 800" (2 pages), Published before Nov. 1, 2000.

Thomas Equipment Ltd. Brochure, "25G" (Model 25G Specifications) (2 pages) Published before Nov. 1, 2000.

Mertz, Inc. Brochure, entitled "BOXER, America's first mini–skid steer with hydraulically adjustable track system." (2 pages), Published before Nov. 1, 2000.

* cited by examiner

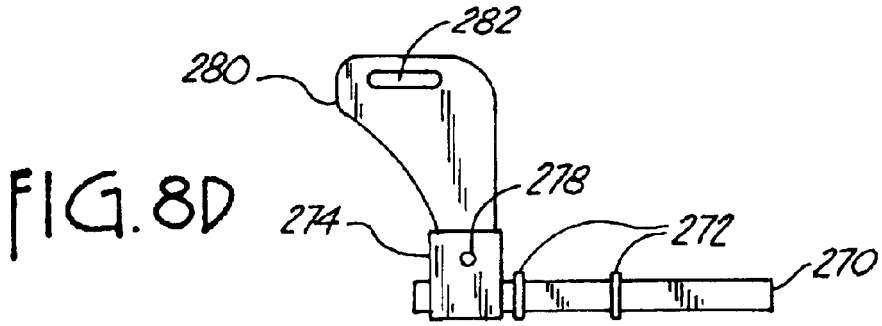
FIG. 8D
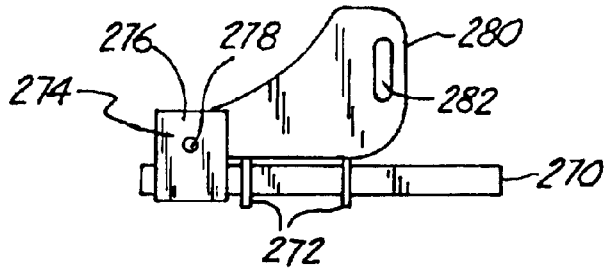
FIG. 8C
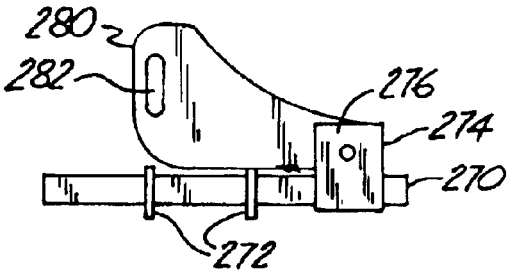
FIG. 8B
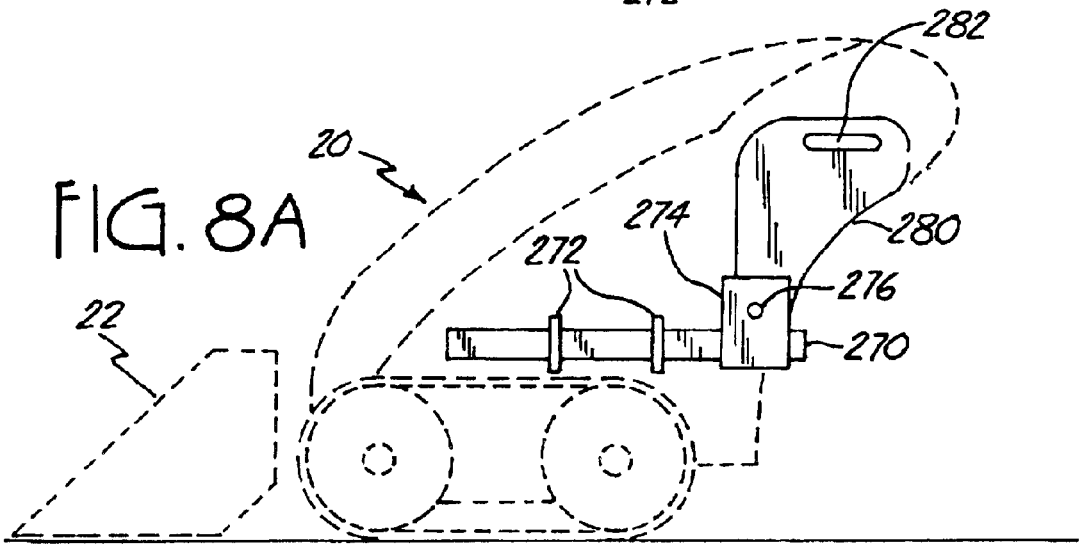
FIG. 8A
FIG. 8

WALK BEHIND APPARATUS FOR OPERATING WORKING ATTACHMENTS

The present application is based on and claims the benefit of U.S. provisional patent application Ser. No. 60/261,296, filed Jan. 12, 2001, the content of which is hereby incorporated by reference in its entirety.

BACKGROUND OF THE INVENTION

The present invention relates to small power assist machines, more specifically to a walk behind loader for operating working attachments.

Power assist machines have been in existence for a number of years. These machines are found in a variety of sizes and take many forms depending upon the tasks for which the machines are designed. Typically, the power assist machines include a plurality of pneumatic support wheels and a cab or seat and foot pedals for the operator of such a device. Such machines are most commonly equipped with a bucket or skid with which material may be moved. Some of the machines are even provided with one or more attachments, which increase the utility of such devices.

While these machines have great utility, they have drawbacks. One drawback of such machines is that they are relatively heavy. This means that the small support wheels, usually having pneumatic tires, have a rather high ground contact pressure and tend to become mired in soft ground. A popular after market attachment for such machines are pairs of endless tracks that are configured to be placed about the tires on the wheels. The tracks are an added expense, they are cumbersome and heavy. Additionally, attachment and removal requires that the machine be taken out of service. They also can become dislodged and disengaged due to misalignment, underinflation of the pneumatic tires, insufficient tensioning of the tracks, stretching of the track due to wear and tear and the like.

Another drawback, related to a limitation of size, is that of auxiliary counterweights. Some of the prior art machines offer auxiliary counterweights, which are used to increase the rated load carrying capacity. However, these weights are usually attached only onto the rear of a machine and serve only to increase the lifting capacity thereof. This is usually tolerated because there is usually only a bucket or other accessory whose lifting requirement needs to be counterbalanced. However, there is no provision for counterbalancing accessories that require front ends of lift arms to provide competing or downward pushing force.

SUMMARY OF THE INVENTION

The present invention relates to a small walk behind loader or apparatus for operating working attachments. The loader includes a ground engaging carriage with a pair of longitudinally aligned wheels or products on each side of the loader. Each pair of wheels drivably supports an endless track. A support frame is attached to the carriage and includes a pair of rearwardly and upwardly extending side members with rear end portions that support rear ends of a lift and a control station. The boom is mounted over center portions of the frame and has a curved or arcuate shape in side view and is positioned so that it extends forwardly relative to the seat end portions of the side members, with the forwardly extending end of the boom configured to removably receive and supply power to a working attachment. The control station includes levers operation linkages which are connected to two separate power motors which enable independent operation of each pair of longitudinally aligned wheels of the ground engaging carriage. The linkages of the controller are automatically urged or biased to a predetermined position in which the drive motors are effectively disengaged from the respective pairs of linearly aligned support wheels. The apparatus also includes at least one selectively positionable counterweight that can be moved relative to the vertical axis of the center of gravity of the loader to increase the operational parameters of the apparatus that is, having the ability to shift the counterweight to counter balance loads to be lifted in one position, and to provide counterweight for compaction or, tamping or drilling forces in a second position.

A feature of the present invention is that at least one counterweight may be selectively positioned relative to the vertical axis of the center of gravity of the apparatus. The curved or arcuately-shaped boom facilitates observation of working attachments at the front end of the boom.

The actuators, couplings, and their attendant power transmission conduits for operating attachments and boom lift cylinder are positioned within the interior space of the boom where they are less subject to damage.

The loader of the present invention is able to traverse and operate in relatively small spaces and has the ability to operate and supply power to a wide variety of working attachments.

BRIEF DESCRIPTION OF THE DRAWINGS

FIG. 8 is a fragmentary side view of an alternative embodiment of the selectively positionable counterweight pods;

DETAILED DESCRIPTION OF THE ILLUSTRATIVE EMBODIMENTS

Figure 1:
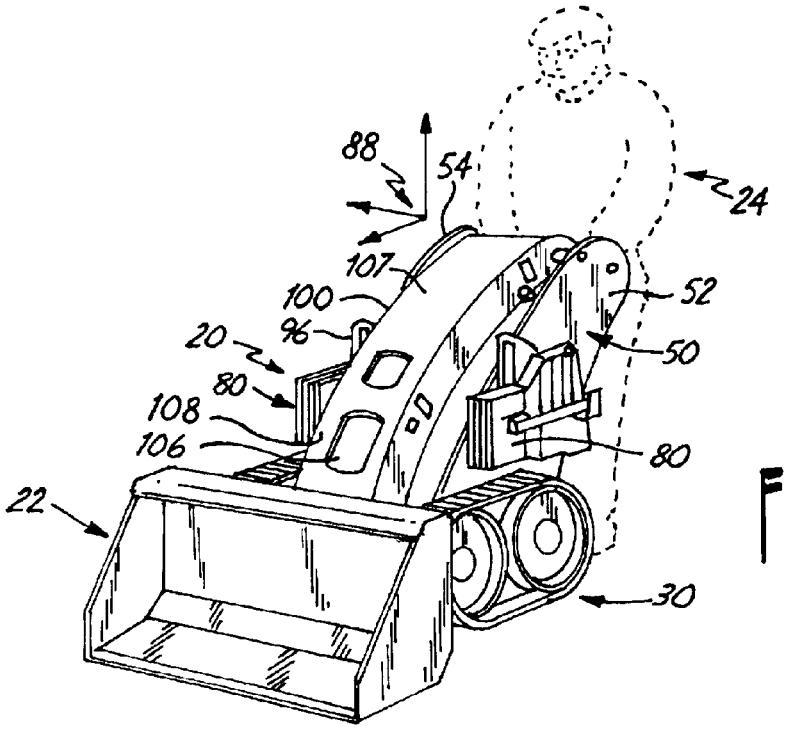
FIG. 1 is a perspective view of the walk behind loader apparatus for operating working attachments showing an operator in phantom lines in accordance with the principles of the present invention.
Figure 2:
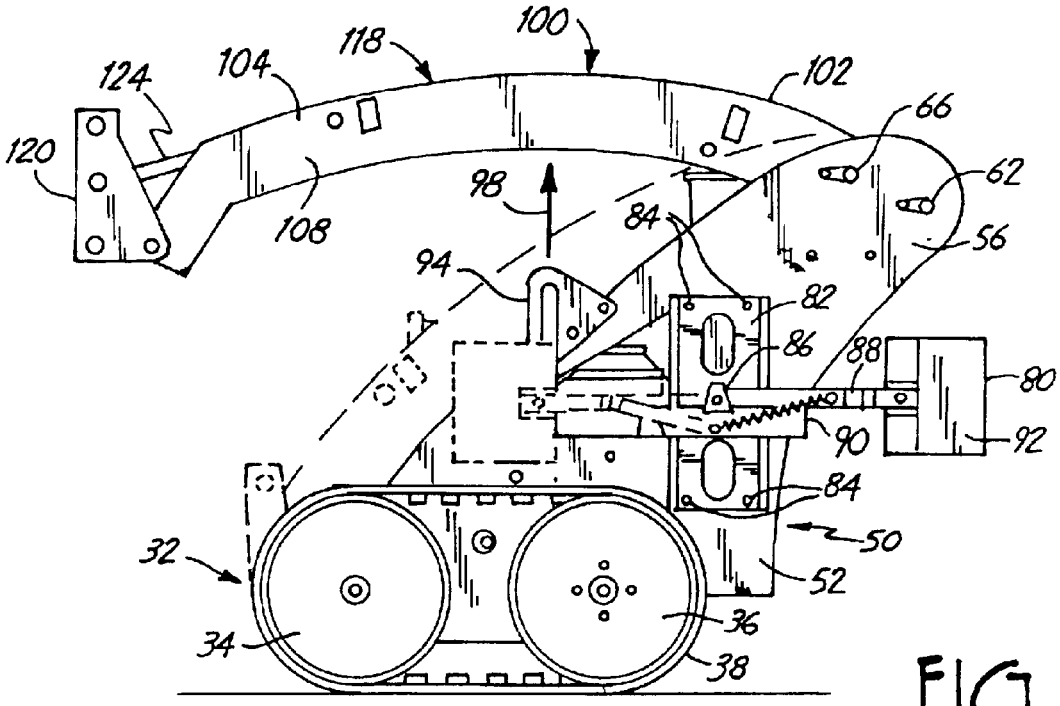
FIG. 2 is a fragmentary side view of the embodiment shown in FIG. 1 illustrating the movement of a boom between a lowered and a raised position, and illustrating the movement of a first form of a selectively positionable counterweight.

Referring now to the drawings and in particular to FIGS. 1 and 2, the self propelled loader or power machine 20 includes a front working attachment 22. For purposes of illustration, the working attachment 22 is a movable bucket. However, other working attachments may be used.

The loader 20 is supported by a wheeled carriage 30 which includes a pair of linearly aligned wheels or sprockets 32 on each side of the machine. As can be seen, each pair of sprockets 32 includes drive sprockets or wheels 36 and front idler sprockets 34 that rotatingly support an endless track 38. The wheeled carriage 30 is attached to a support frame 50. The support frame 50 includes a pair of spaced side plate members 52 and 54 that include rearwardly and upwardly extending portions 56 and 58.

Figure 3:
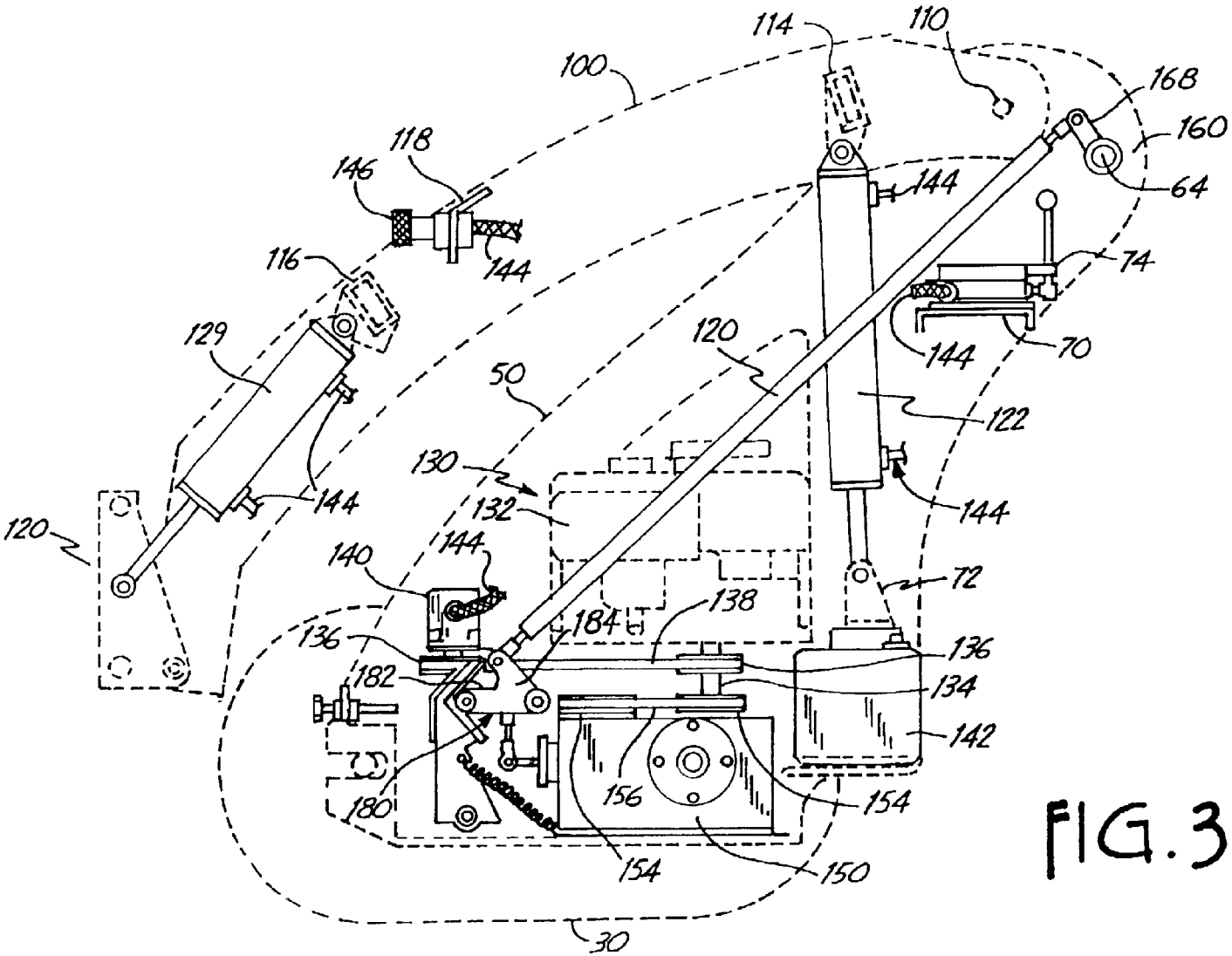
FIG. 3 is a fragmentary side view of the loader illustrating the locations of the controller for the wheeled carriage, the boom actuators, and the power coupling for a working attachment.
Figure 4:
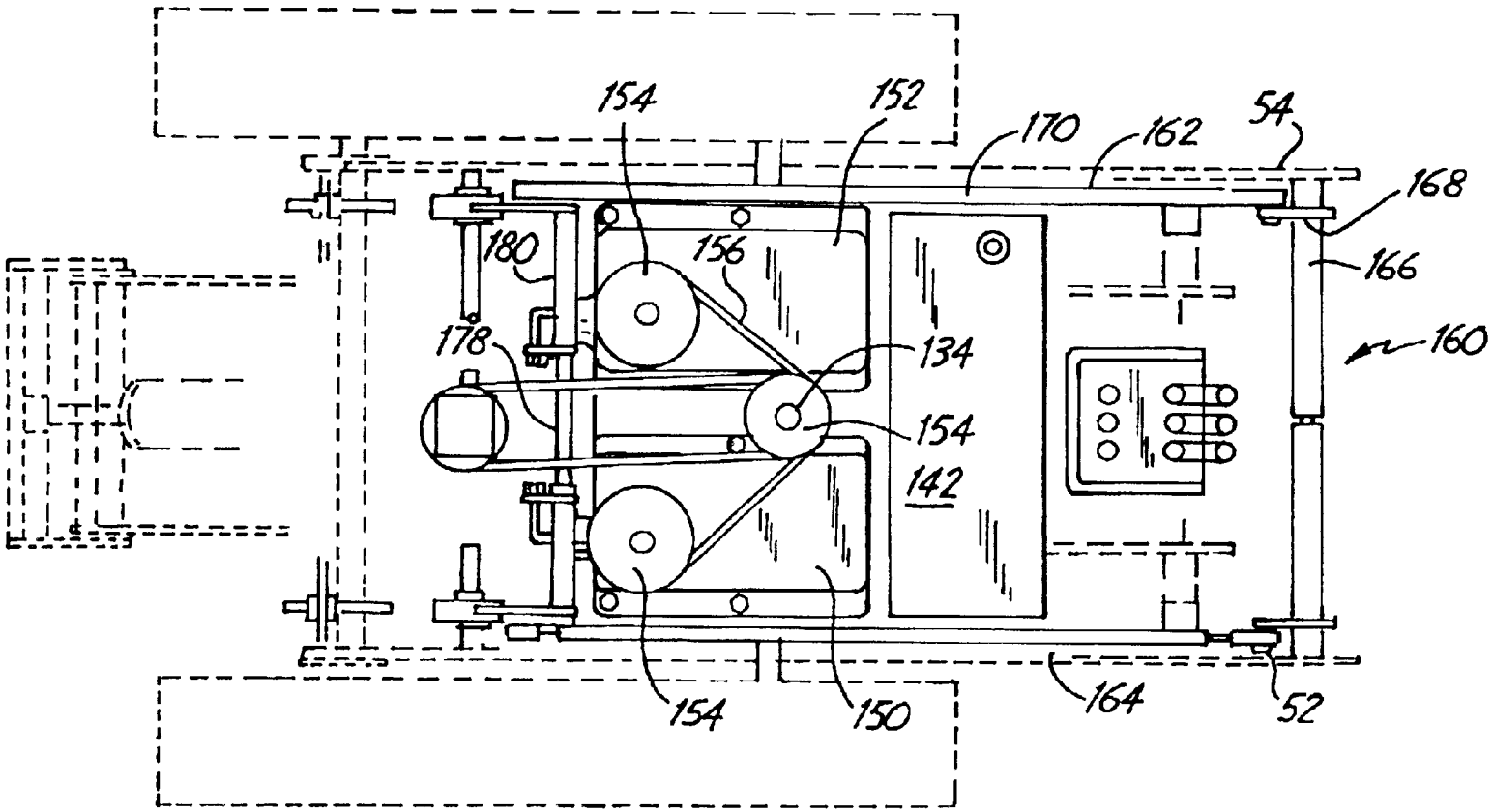
FIG. 4 is a fragmentary top view of the loader illustrating the controller, the drive units, and the motor unit.

As depicted more clearly in FIGS. 3 and 4, the rearwardly extending plate portions 56 and 58 support an operator's station or controller 160 at attachment points 60 and 62. The rearwardly extending plate portions 56 and 58 also are used for pivotably mounting a working attachment manipulating member or boom 100. The boom 100 includes a rearward or proximal end 102 and a front or distal end 104, with the proximal end being attached to the rearwardly extending plate portions 56 and 58 and extending between the plate portions. The distal or front end 102 of the boom 100 has an attachment plate 120 pivotally attached to the front end 104 of the boom 100 in a conventional manner and includes an operator controlled double action hydraulic actuator 124. The boom 100 itself is arcuately-shaped to allow an operator shown in dotted lines at 24 to more easily view the front end of the boom and the particular working attachment attached thereto. The boom 100 is of a box beam construction having side walls 108 and top and bottom walls 107 defining an interior space 106. The box beam construction is preferred not only because of the inherent strength characteristics associated with this type of construction, but also because it allows components such as actuators, couplings, and power transmission conduits to be positioned in the interior in a relatively protective environment. Access to the interior 106 of the boom 100 is provided by appropriately sized and located cut-outs or access panels in the top or bottom walls 107.

The support frame 50 also supports a pair of selectively positionable counterweights 80. Each counterweight 80 is attached to a bracket 82 that is in turn attached to side member 52 and 54 by fasteners 84. The counterweight 80 is supported on an arm 88 having one end that is pivotally attached to the bracket 82 at a pivot point 86 with a weight pod 92 attached to the other end of the arm 88. The weight pod 92 may be pivoted forwardly and rearwardly relative to the loader 20, and more importantly the weight 92 pod may be pivoted forwardly and rearwardly relative to the transverse vertical plane represented by line 98 passing through the loader center of gravity. This feature has the effect of increasing the operational parameters of the loader, such as lifting capacity of a bucket and alternately providing greater weight at the front of the loader for compaction and the like.

When the weight pod 92 is positioned rearwardly with respect to the center of gravity vertical axis 98, the boom 100 is able to lift a greater amount of weight. Thus, the weight pod allows the loader to have the lifting capacity of a larger machine. This is particularly useful for working attachments such as buckets, grapple units, lifting forks, mixers and the like.

Conversely, when the weight pod 92 is positioned forwardly with respect to the center of gravity vertical axis 98, the outer end of the boom 100 is able to exert a greater amount of downward force. This is particularly useful for working attachments such as augers, ground rakes, trenchers, ground saws, wheel packers, backhoes, land levelers, and the like.

The selectively positionable counterweight feature of this invention enables the loader to have relatively small dimensions, on the order of less than four feet in height and less than three feet in width. The preferred height is equal to or less than forty-five inches and the preferred width is equal to or less than thirty two inches or a standard sized door. The small dimensions allow the walk behind apparatus to operate and negotiate in a variety of locations that preclude use by larger machines. The loader of the preferred size may operate inside of structures such as houses, may negotiate stairwells, and operate in stalls, with the effectiveness of a much larger machine. It will be appreciated that the weight pods of the walk behind apparatus may be positioned close to the center of gravity in fore and aft direction in a somewhat neutral position to effectively increase traction when a towing or pushing motion is involved. It may also be appreciated that the weight pods may be omitted, if desired.

The selectively positional counterweight 80 may be subject to bouncing and jarring. So, to reduce this undesirable effect, a biasing element or spring 90 is attached between the moment arm 88 and the bracket 82. This biasing element 90 reduces undesirable bouncing by pulling the selectively positional counterweight 80 against the relatively rigid bracket 82.

Referring now also to FIG. 3, the attachment bracket 120 is attached to the front end 104 of the boom and provided with a second actuator 124 having ends connected to the bracket 120 and a second actuator support member 116. The second actuator 124 is operatively connected to a motor unit 140 by conventional power transmission conduits 144. Continuing along the boom 100, a hydraulic coupling 146, connected to an attachment member 118 is preferably located adjacent the attachment bracket 120 so that a powered working attachment (such as an auger or a sweeper, not shown) may be powered from the hydraulic system of the loader 20. A pump is connected to the coupling 146 by conventional conduits 144. The proximal or rear end 102 of the boom 100 is pivotally attached at the upper ends of the frame support at 110 and 112, which correspond to pivots pins 66 and 68. A first actuator 122 is used for controlling the pivoting of the boom and has a rod end connected to a support member 72 attached to the support frame 50. The actuator 122 has a base end attached to a cross member 114 on the boom. The actuator 122 is operatively connected to pump 140 through a valve by conduits 144.

A boom and working attachment control assembly 74 is attached between the side members 52 and 54 of the support frame 50 at support member 70. An operator is able to control the first and second actuators 122, 124 and attachments coupled to power coupling 146 from control assembly 74. The control assembly 74 is operatively connected to the hydraulic pump 140.

The pump 140 is driven from a power source 130 which has a primary engine 132 and a rotatable shaft 134. The shaft 134 is connected to the pump 140 by a pair of pulleys 136 and a flexible drive belt 138. Preferably, the pump 140 is a hydraulic pump, and to that end, a hydraulic fluid reservoir 142 is provided to ensure that an adequate supply of hydraulic fluid is maintained to the hydraulic circuitry.

Referring now also to FIG. 4, the loader 20 includes a drive controller 160. The controller 160 comprises two linkages 162, 164, respectively, which are used to control propelling the loader 20. The controller 160 includes left and right operator grips 166 which are rotatably mounted on a shaft or bar 64 that extends between the side frame members 52 and 54. Since the construction of the linkages is essentially the same, only one linkage 162 will be discussed in detail. The linkage 162 comprises an operator grip 166 that is connected to a crank arm 168. The crank arm is pivotally attached to a first connecting member 170 that extends downwardly and forwardly toward the front of the loader where it is pivotally connected to a bracket 180.

Figure 5A:
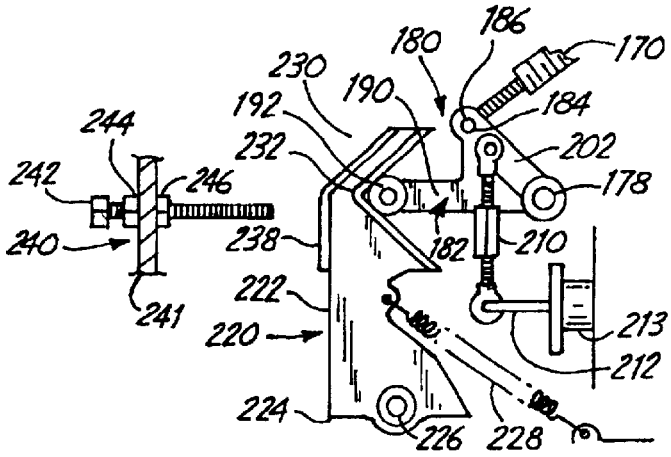
FIG. 5A is a fragmentary side view of the controller illustrating a linkage in a predetermined position where a drive unit is effectively disengaged from an associated track drive wheel or sprocket wheels.
Figure 5B:
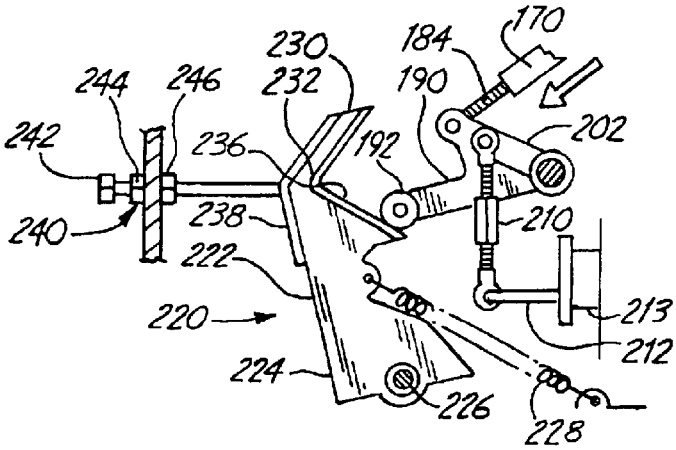
FIG. 5B is a fragmentary side view of the controller illustrating the linkage of FIG. 5A in which an operator hand control has been rotated in the direction of desired travel of the apparatus (i.e., forward)

Referring now also to FIGS. 5A, 5B. 5C and 5D, the bracket 180 comprises a first portion 182 that has a crank arm 184 that is pivotally connected to the first connecting member 170 at point 186 with a conventional fastener (not shown). The first portion 182 also includes a displacement arm 190 and a cam follower roller 192 which are configured to cooperatively engage a centering cam member 220. The bracket 180 includes a spacer or sleeve 194 (see FIG. 5D) that connects the first portion 182 to a second arm 200 which includes a follower or crank arm 202 which is pivotally attached to a second connecting link 210 at point 204 with a conventional fastener (also not shown). The second control member connecting link 210 is in turn attached to a valve 212 of a valve 213. The bracket 180 is rotatably attached to a shaft 178 that extends between the side members 52, 54 of the support frame 50.

As will be appreciated, the movement of the linkage 162 is limited by the interaction of the displacement arm 190 and cam roller 192 with a centering cam member 220. The centering cam member 220 comprises a cam body 222 having a first end portion 224 that is pivotally attached to the support frame 50 at point 226. The cam body 222 also has a second end portion 230 that includes a V-shaped cam notch 232. The cam notch 232 includes a cam surface 236 against which the cam roller 192 rides. An adjustable stop member 240 contacts a stop bracket surface 238 on cam body 222. As can be seen the V-shaped cam notch 232 faces the cam follower 192 of the displacement arm 190.

As depicted in FIG. 5A, the cam roller 192 is at the apex of the cam notch 232. This position corresponds to a neutral or idle position on the controller 160. In FIG. 5B the first connecting link 170 has been actuated by an operator grip 166 so that the arm 190 of bracket 180 displaces the centering cam member 220 about its pivot 226. When this occurs, the bracket 180 also moves the second link 210, which is connected to the valve spool control member 212. The motion of the valve spool control member 212 corresponds to forward movement on the directional controller operation handle. As the cam member 220 is displaced by the cam follower roller 192 on bracket 180, the centering cam member 220 encounters adjustable stop member 240.

The adjustable stop member 240 limits the extent to which the centering cam member 220 may be pivotally displaced. With the left and right adjustable stop members, it is possible to synchronize the maximum forward speeds of the left and right drive units. The stop member 240 has a cap screw 242 extending through a fixed wall 241 of the frame. The position of cap screw 242 may be adjusted by manipulating nuts 244 and 246.

Figure 5C:
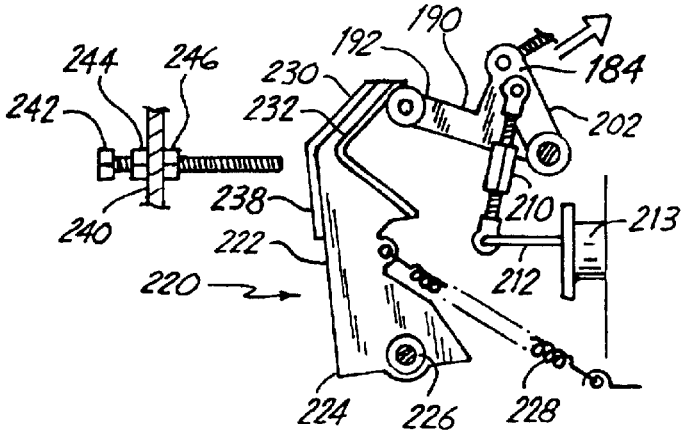
FIG. 5C is a fragmentary side view of the controller illustrating the linkage of FIG. 5A in which an operator hand control has been rotated in the direction of desired travel of the apparatus (i.e., reverse)
Figure 5D:
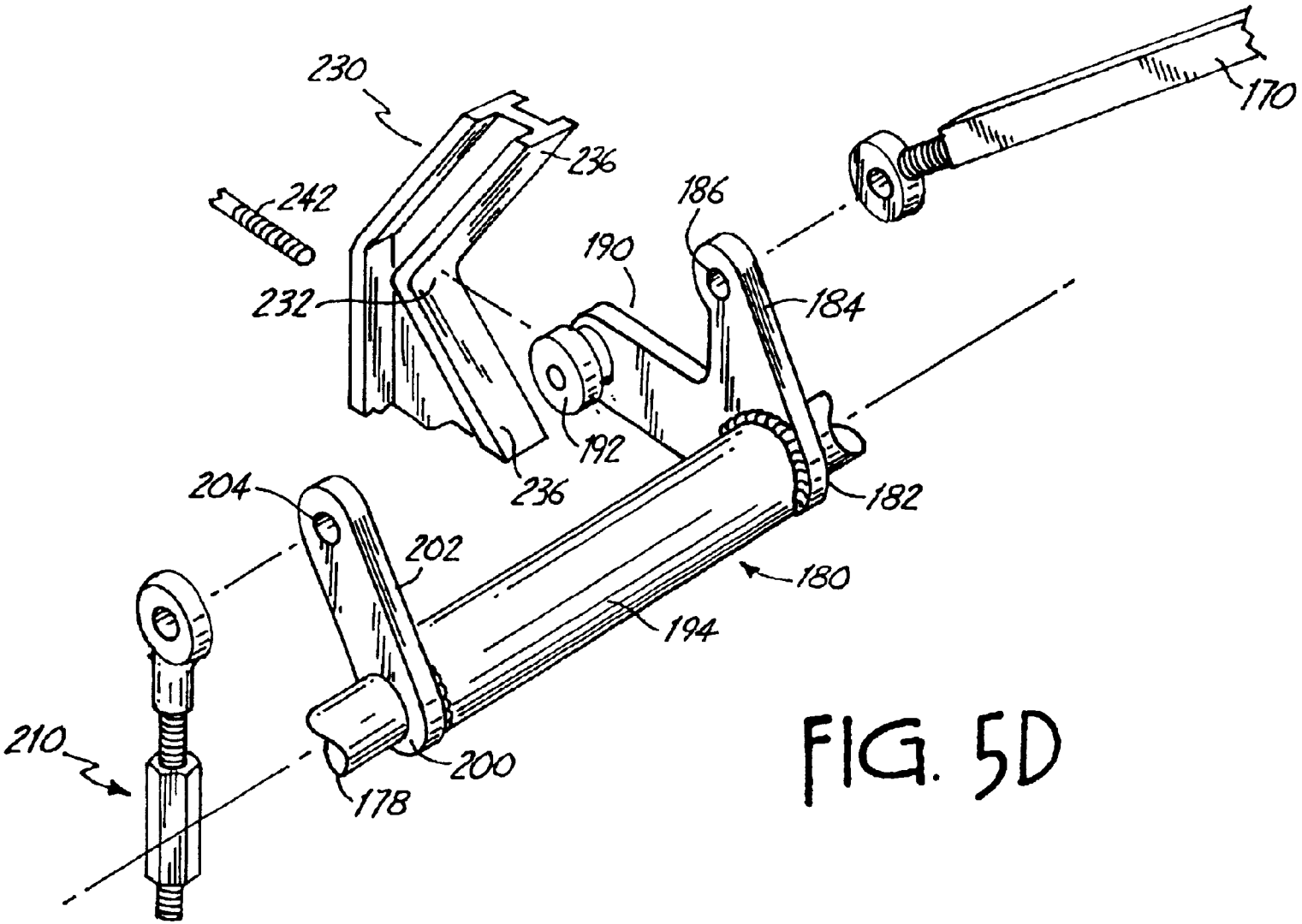
FIG. 5D is a fragmentary, perspective, exploded view of the linkage of FIG. 5A illustrating the relationship between the various interacting components.

FIG. 5C shows the control position when the operator grip 166 of the directional controller 160 is rotated in the opposite (rearward) direction. The first connecting member 170 displaces bracket 180 so arm 190 raises and cam roller 192 move upwardly to pivot the centering member 220. When this occurs, the bracket 180 also raises the second link 210, which in turn displaces the valve control member 212 in an upward motion what would correspond to reverse on the controller. Note in this instance, that the centering cam member 220 does not encounter the adjustable stop member 246. This is because the geometry of the linkage 162 is self-limiting. Another feature of the centering cam member 220 is that in the absence of an operator input force, the centering member 220, by virtue of a biasing element 228 will urge the bracket 180 and therefore the directional control 160 to a neutral position. Thus, should an operator inadvertently or purposely let go of the operator grips 166, the loader will come to a stop.

Operation is straightforward. In order to move in a forward direction, an operator would grasp and rotate the grips 166 in a forward direction, which corresponds to normal forward drive motion of the loader. In order to move in a rearward direction, the operator would grasp and rotate the grips 166 in a reverse direction, which corresponds to normal reverse drive motion of the carriage. It will be appreciated that turning may be accomplished by operating a single grip, rotating both grips in the same direction but at different degrees, or by rotating the grips in opposite directions. Referring again to FIGS. 3 and 4, each linkage 162 and 164 is connected via brackets to drive units 152, 150, respectively. Preferably, the drive units are hydrostatic swash plate pumps and motor units that are operatively connected to the power source 130 by a second set of pulleys 154 operatively connected to a flexible drive belt 156. The respective pumps drive motors at a variable speed so the speed of output shafts 134 is dependent on the position of the linages 162, 164 at a rated speed of engine 132.

Figure 6:
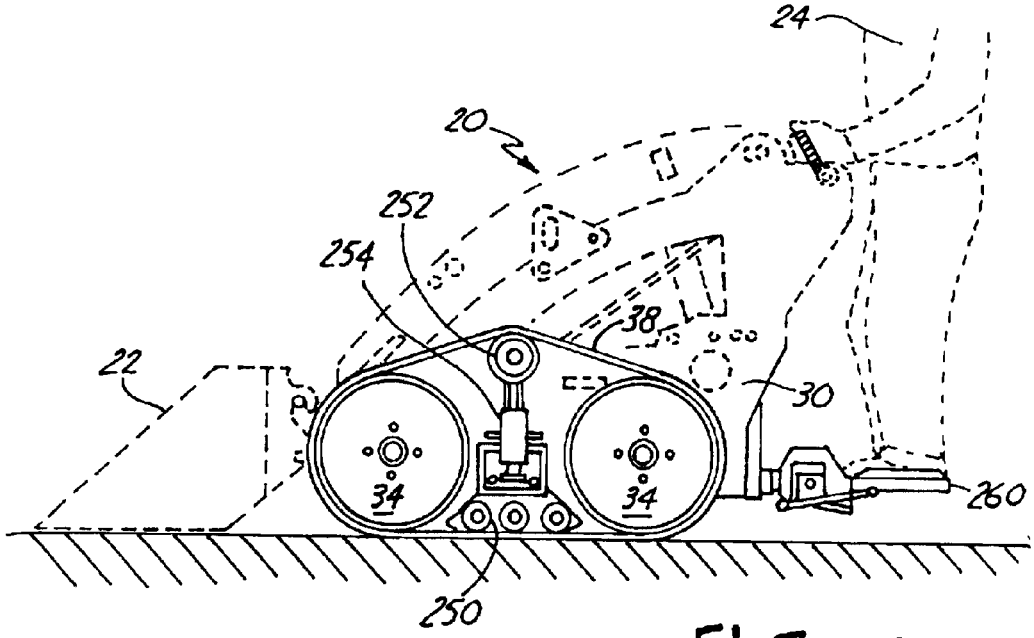
FIG. 6 is a fragmentary side view of an alternative embodiment of the apparatus illustrating an endless track tensioning device and an operator support.

FIG. 6 depicts an alternative embodiment in which the wheeled carriage 30 is provided with a bogy wheel set 250 to provide intermediate support between wheels 34 and 36. This embodiment also includes a tensioning wheel 252 with a biasing element 254 on the top length of the track to assist maintaining the endless track 38 on the wheels or sprockets 34 and 36.

Figure 7:
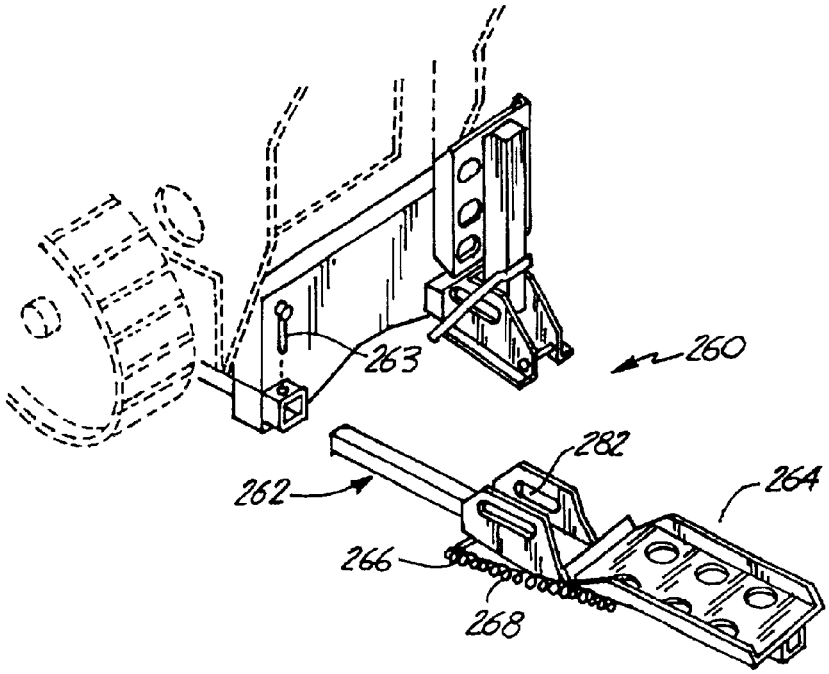
FIG. 7 is a fragmentary perspective view of the operator support illustrating attachment and a storage position.

FIGS. 6 and 7 depict an operator support 260 for an operator 24 of the loader 20. Normally an operator will walk behind the loader. The support 260 includes an attachment portion 262, which is configured to be received within an aperture in the support frame. The operator support may be locked to the support frame by a pin 263 or other fastener. The operator support 260 includes a support portion 264 on which a user would stand. Preferably, the support portion 264 is pivotable (at point 268) with respect to the attachment portion 262, so that the support portion 264 may be left on the walk behind apparatus and rotated out of the way when not in use. A retainer element 268 ensures that the support portion 264 remains in either the use or the storage positions. The operator support 260 also includes handholds 282 for easy manipulation and transport.

FIGS. 8A–8D depict an alternative embodiment of the weight pod and attachment. As with the bracket in the first embodiment, and as shown in FIG. 8A, a support bar 270 is attached to the side members by brackets 272. In a departure from the earlier embodiment, there is a movable attachment element 274 which may be positioned along the support bar 270. A counterweight or weight pod 280 is rotatably attached to the attachment element 274 at an attachment point 276 by a suitable fastener 278. As will be appreciated, the weight pod 280 may be attached to the attachment element 274 so that it points forwardly or rearwardly. As with the operator support, the weight pod includes a handhold 282 for easy manipulation and transport.

FIG. 8B illustrates the weight pod 280 pivoted forwardly from the position shown in FIG. 8A.

In FIGS. 8C and 8D, the attachment element 274 has been shifted to the forward end of the support bar 270. The weight pods 280 are shown in two different pivoted positions in FIGS. 8C and 8D.

Figure 9:
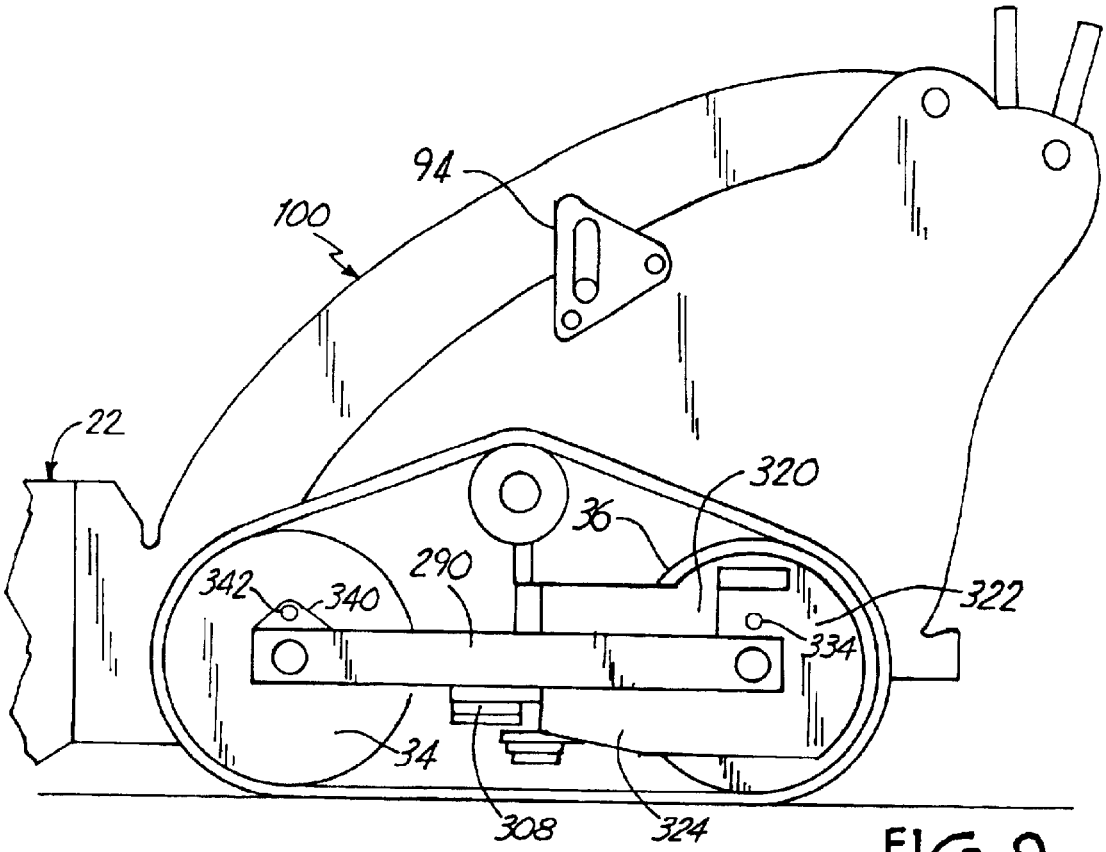
FIG. 9 is an enlarged fragmentary side view of an alternative embodiment of the selectively positionable counterweight pods.
Figure 11:
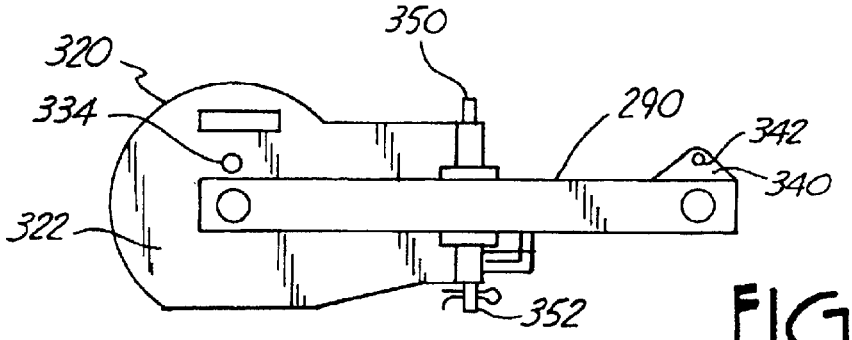
FIG. 11 is a side view of the counterweight shown in FIG. 9 in a forward position.
Figure 10:
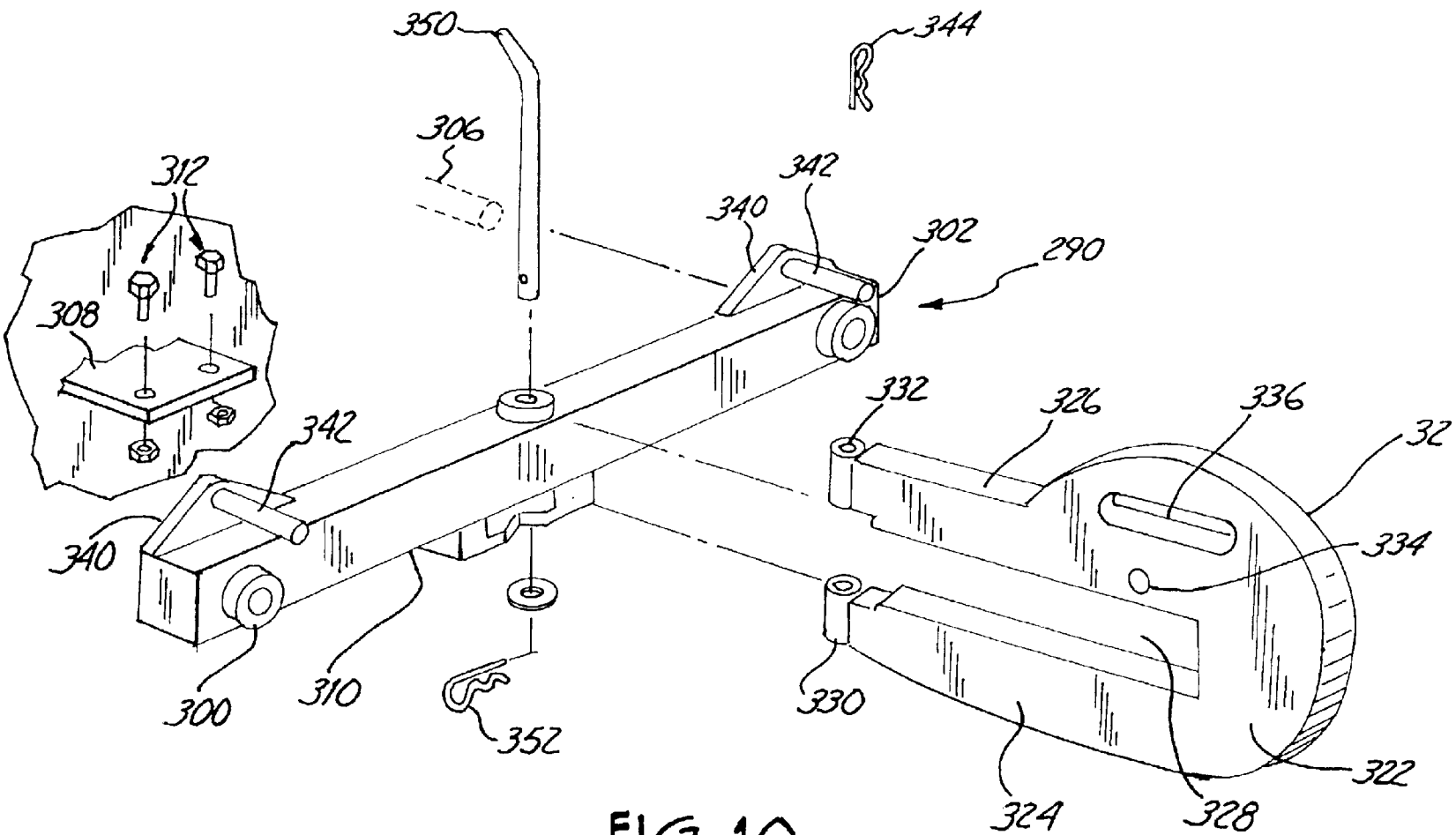
FIG. 10 is an exploded, fragmentary perspective view of the alternative embodiment of FIG. 9.

FIGS. 9, 10 and 11 depict another embodiment of the weight pod and attachment. A support bar 290 is attached to the axles for the sprockets or wheels 34 side of the apparatus at a lower location, on the level of the wheel axes. This location is preferred because it lowers the center of gravity to even a greater degree. The support bar is provided with bushings in apertures 300 and 302, which are sized to be rotatably supported on axles 304 and 306 of the sprockets or wheels. A plate 310 on the lower side of the support bar 290 is supported on a flange 308 (FIG. 10), which is fixed to and extends from the respectable side late 52, 54. The support base 296 is held with fastening elements 312 of a conventional nature. A counterweight or weight pod 320 has a major weight portion 322 and arms 324, 326 which define a notch 328 the notch receives the support bar 290. Each arm 324, 326 is provided with a sleeve 330, 332, respectively, which are aligned with a vertical aperture 314 in support bar 290. The arms are pivotally retained by a pin 350 and its retaining element 344. Note that the notch 328 defined by the arms 324, 326 is of sufficient length to receive the entire support bar when the weight 320 is selectively pivoted to a forward or rearward position with the arms overlying the support bar. As illustrated in FIGS. 9 and 11, the weight pod 320 may be positioned to the front or rear of the vertical axis passing through the center of gravity of the loader. The center of gravity is approximated by the location of a lifting bracket 94 shown in FIG. 9. The weight pod 320 is also provided with a transverse aperture 332, which is sized to admit one or two pins 342, which are fixed to the support bar 290 with upright flanges 340 at the front and rear of bar 290, respectively. As the weight pod 320 is pivoted into a position either the front position shown in FIG. 11 or the rearward position shown in FIG. 9, where the arms and counterweight pod 320 are co-planar with the support bar 290, aperture 332 receives pin 342. The weight pod 320 is then secured in place on the support bar 290 by a cotter pin 344. As with the other embodiments, the weight pod 320 is provided with a handhold 336 for ease of manipulation and transport.

In use, the position of the counterweight or weight pod is determined by the type of work to be done. If the situation requires additional lifting capacity, then the weight is selectively positioned to the rear of the vertical component of the center of gravity. If the situation requires additional weight to assist in downward force or motion, the counterweight is selectively positioned forward of the vertical component of the center of gravity.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

Although the present invention has been described with reference to preferred embodiments, workers skilled in the art will recognize that changes may be made in form and detail without departing from the spirit and scope of the invention.

What is claimed is:

1. A loader for operating working attachments, the loader comprising:

a support frame including a pair of side members adjacent a rear of the loader;

a ground drive comprising supports on opposite sides of the loader for propelling the loader;

a boom having first and second ends, the first end of the boom pivotally attached to the side members of the support frame and positioned so that it extends forwardly relative to the side members, the second end of the boom configured to receive a working attachment at a forward end of the support frame;

an actuator, the actuator being operatively connected between the boom and the support frame to pivot the boom with respect to the support frame;

a power source for providing power to the actuator; and at least one selectively positionable counterweight pivotably mounted on the support frame about an upright pivot axis along a side of the support frame, the upright pivot axis being positioned with respect to a center of gravity of the loader, the counterweight having first and second positions about the upright pivot axis, a major portion of the counterweight being positioned on a forward side of a vertical plane passing through the center of gravity in a first pivoted position and being positioned on a rearward side of the vertical plane in a second pivoted position.

2. The apparatus according to claim 1, further comprising at least one coupling, the coupling configured to operatively connect the power source to a working attachment.

3. The apparatus according to claim 2, wherein the coupling is attached to the second end of the boom.

4. The apparatus according to claim 3, wherein the power source comprises a pump operatively connected to a power supply.

5. An apparatus for operating working attachments, the apparatus comprising:

a ground engaging wheeled carriage comprising powered first and second endless tracks on sides of the carriage;

a power source for providing power to the wheeled carriage; and, a controller, the controller operatively controlling the power source to selectively drive the endless track of the wheeled carriage, the controller including first linkages and second linkages, the first and second linkages being connected to control power to the first and second tracks, respectively; whereby the first and second tracks may be independently operated;

the power source including a first drive unit and a second drive unit, with the first and second drive units operatively connected to the first and second tracks, and wherein the first and second linkages are operatively connected to the first and second drive units, respectively, the first and second linkages being urged into and maintained in a predetermined position in which the drive units are effectively disengaged from the tracks, the first and second linkages including first and second brackets, and wherein the controller further comprises first and second centering cam members, the first and second centering cam members being configured to urge and maintain the first and second brackets in predetermined positions;

a support frame attached to the wheeled carriage, the support frame including a pair of laterally spaced rearwardly and upwardly extending side members; and, a boom having two ends, one end of the boom pivotally attached to the rearwardly and upwardly extending side members of the support frame and positioned between the side members so that the boom extends forwardly relative to the side members, the other end of the boom configured to receive a working attachment.

6. The apparatus according to claim 5, wherein the power source further includes an engine operatively connected to the first and second drive units.

7. The apparatus according to claim 5, wherein the first and second centering members include V-shaped cam notches, respectively, which are configured to receive and guide a respective displacement arm of the first and second brackets into the predetermined positions in the absence of an operator's input.

8. The apparatus according to claim 7, further including first and second stops, wherein the first and second stops are configured to engage the first and second centering members, respectively, to permit synchronization of the first and second drive units.

9. A self propelled loader for operating working attachments, the loader comprising:

a ground engaging drive carriage;

a support frame attached to the driver carriage, the support frame including a pair of rearwardly and upwardly extending side members;

a loader boom movably attached to the side members of the support frame and positioned so that the loader boom extends forwardly relative to the side members, a forward end of the loader boom configured to releasably retain and operate a working attachment, the loader having a predetermined center of gravity; and at least one selectively positionable counterweight movably mounted on the support frame, the counterweight being movable with respect to a laterally extending vertical plane passing through the center of gravity of the loader to opposite sides of the plane for modifying the effect of the counterweight on the loading capabilities of the forward end of the loader boom.

10. The apparatus according to claim 9, wherein the at least one selectively positionable counterweight may be diametrically positioned relative to the vertical plane.

11. The apparatus according to claim 10, wherein there are two selectively positional counterweights, one on each side of the support frame.

12. The apparatus according to claim 11, wherein the selectively positionable counterweights are pivotably attached to and positioned on an outside surface of the side members of the support frame for movement about an upright axis.

13. The apparatus according to claim 12 wherein the counterweights are pivotably mounted to position a mounting of the counterweight forwardly and rearwardly with respect to the vertical plane.

14. A method of extending the operational parameters of a walk behind apparatus for operating working attachments comprising:

a walk behind apparatus including:

a ground engaging drive carriage;

a support frame attached to the drive carriage, the support frame including a pair of rearwardly and upwardly extending side members; and, a boom having two ends, one end of the boom pivotally attached to the rearwardly and upwardly extending side members of the support frame and positioned so that it extends forwardly relative to the side members, the other end of the boom configured to receive a working attachment;

the method comprising:

attaching a movable counterweight to the support frame of the apparatus about an upright pivot adjacent a center of gravity of the apparatus, and selectively positioning the counterweight in a first position forwardly of the upright pivot and in a second position rearwardly of the pivot to position the counterweight selectively forwardly of and rearwardly of the center of gravity of the apparatus.

15. The apparatus according to claim 14, wherein the attaching a movable counterweight further include attaching a pair of movable counterweights to the frame of the apparatus on opposite sides thereof.

* * * * *